US005126517A

United States Patent [19]

Torres-Isea et al.

[11] Patent Number: 5,126,517

[45] Date of Patent: Jun. 30, 1992

[54] ARC SUPPRESSING CURRENT INTERRUPTER

[75] Inventors: Ramon O. Torres-Isea, Cedar Rapids; Gary W. Scott, Mt. Vernon; Christopher K. Goble, Marion, all of Iowa

[73] Assignee: Square D Company, Palatine, Ill.

[21] Appl. No.: 580,715

[22] Filed: Sep. 11, 1990

[51] Int. Cl.[5] ..... H01H 33/06; H01H 9/32

[52] U.S. Cl. ..... 200/151; 200/144 R

[58] Field of Search ..... 200/151, 144 R

[56] References Cited

U.S. PATENT DOCUMENTS

| | | | |
|---|---|---|---|
| 4,562,323 | 12/1985 | Belbel et al. | 200/151 |
| 4,596,911 | 6/1986 | Guery et al. | 200/151 |
| 4,677,266 | 6/1987 | Belbel et al. | 200/151 |

*Primary Examiner*—Harold Broome

*Attorney, Agent, or Firm*—Jose W. Jimenez; Laurence J. Marhoefer

[57] ABSTRACT

A current interrupter in which a first movable, insulating, gear carries a contact blade. The blade extends out from this movable gear and forms a contact which makes and breaks with a stationary contact upon movement of the gear. A second insulating gear has a set of teeth which engage the teeth on the first gear. The second gear has a cavity into which the extended contact fits. Movement of the first gear in a direction to break the contact, causes the engaged teeth to drive the extended contact into the cavity, thereby insulating the movable contact from the stationary contact. The interlocking gear teeth create a tortuous path for the arc and provide a large over surface distance for dielectric strength.

9 Claims, 5 Drawing Sheets

ARC SUPPRESSING CURRENT INTERRUPTER

BACKGROUND OF THE INVENTION

1. Field of the Invention

The present invention generally relates to electric current interrupters such as switches and circuit breakers, and more particularly to an improved interrupter in which an insulating member is inserted between the contacts as they open in order to extend the arc path and destabilize any arc which forms.

2. Description of the Prior Art

Electric power interrupters of the type contemplated by this invention such as switches, circuit breakers, and contactors, employ contacts which are opened to interrupt relatively large currents. This interruption can generate powerful arcs whose energy must be dissipated, preferably away from the current conducting contacts.

There have been a number of proposals in the prior art for destabilizing the arc as the contacts are opened. These include rapidly inserting an insulating member between the contacts as they open. U.S. Pat. Nos. 4,562,323; 4,596,911; and 4,677,266 are prior art disclosures of current interrupters in which an insulator is inserted between the contacts as they open. While satisfactory in principle, these prior art devices are mechanically complex.

SUMMARY OF THE INVENTION

It is therefore an object of the present invention to provide a current interrupter in which a simple unitary mechanical mechanism simultaneously opens the contacts and inserts an insulating member between them.

Another object of the invention is the provision of an assembly which is physically compact and yet provides an extended arc path upon contact opening; an assembly which eliminates the need for flexible conductors and conducting joints, and, as may be inferred from the first statement of invention objective, one which eliminates the need for two separate linkages, one for moving the insulating separator and one for contact blade actuation.

Briefly, this invention contemplates the provision of a current interrupter in which a first movable, insulating, gear carries a contact blade. The blade extends out from this movable gear and forms a contact which makes and breaks with a stationary contact upon movement of the gear. A second insulating gear has a set of teeth which engage the teeth on the first gear. The second gear has a cavity into which the extended contact fits. Movement of the first gear in a direction to break the contact, causes the engaged teeth to drive the extended contact into the cavity, thereby insulating the movable contact from the stationary contact.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
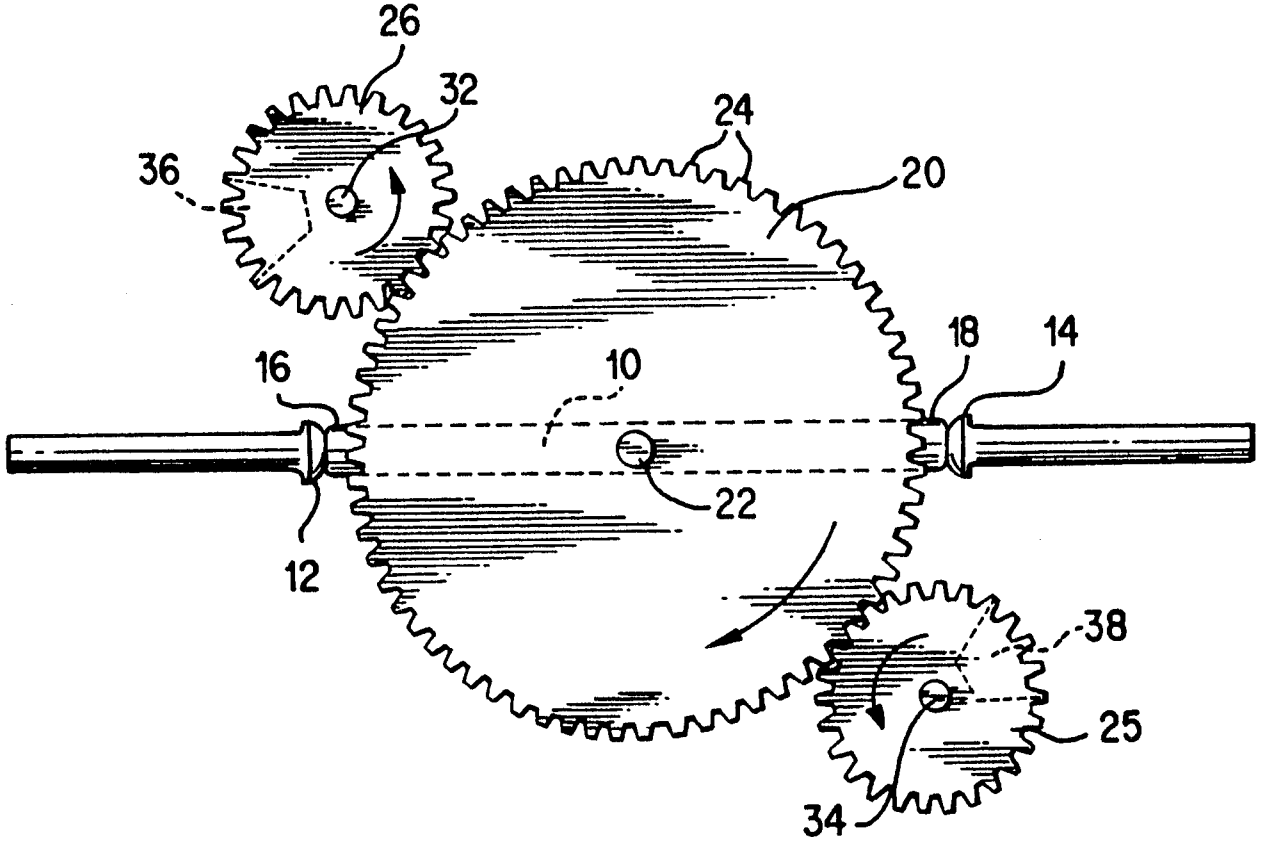
FIG. 1 is a schematic drawing of one embodiment of a double break current interrupter in accordance with the teachings of this invention.

Referring now to the drawings, and more particularly to FIG. 1, a current interrupter, such as a switch or circuit breaker in accordance with one embodiment of the teachings of this invention, has a movable current conducting bridge or blade 10 which connects and disconnects a pair of stationary contacts 12 and 14. The blade 10, except for its two protruding contacting surfaces 16 and 18, is completely enclosed in, and is secured to, a toothed wheel or gear 20 made of a suitable insulating material and rotably mounted on an axle 22. Teeth 24 on the gear 20 mesh with teeth on two pinions 26 and 28 which are also made of a suitable insulating or arc resistant material such as glass filled nylon. The pinions 26 and 28 are mounted respectively for rotation about axles 32 and 34. Cavities 36 and 38 are formed respectively in the gears 26 and 28. The relative position of the axles, the size of the gears, and the rotational position of the cavities 36 and 38 is established so that the ends 16 and 18 fit into the cavities 36 and 38 as gear 20 is rotated in a clockwise direction in this specific embodiment. Preferably the geometry is such that the ends 16 and 18 of the contacts enter the cavities 36 and 38 after the gears have rotated through a very short distance; as short as possible. After the ends 16 and 18 enter the cavities, rotation stops, and the insulating gears 20, 26 and 28 form an insulating barrier between the fixed contacts 12 and 14 and the movable contacts 16 and 18. Typically, gear 20 would be a driven member and pinions 26 and 28 idlers, although pinions 26 and 28 could be the driven members. The teeth on the gears 20, 26 and 28 provide a positive positional relationship between the contact ends 16 and 18 and the cavities 36 and 38, and in addition provide a tortuous path for any arc which forms upon contact opening. The meshed gear teeth provide an additional insulating barrier to the arc. Thus it will be appreciated that enclosing the ends 16 and 18 of blade 10 in the insulating cavities 36 and 38 insulates the movable contacts 16 and 18 from the stationary contacts 12 and 14 and increases the arc path, making the arc easier to extinguish. The meshed gear teeth provide a simple, positive, unitary mechanism which simultaneously breaks the contacts and inserts an insulating barrier between them. The combination of spur and pinion gears might be replaced by any gear configuration of various geometries (rack, pinion, helical, etc). At least one of the gears should incorporate one or more cavities to accommodate the protruding contact surface of blade within an adjacent gear.

Figure 2:
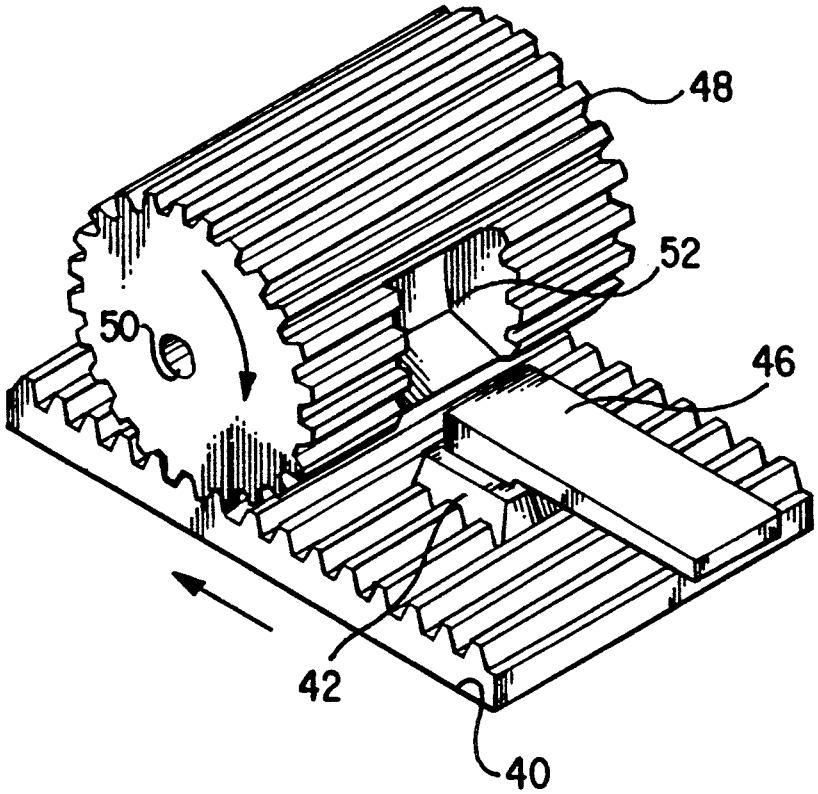
FIG. 2 is a partial, perspective view of another embodiment of a current interrupter in accordance with the teachings of this invention.

Referring now to FIG. 2, in this embodiment a toothed member or rack 40 made of a suitable material carries a conducting blade (not shown) with a contact end 42 extending from the rack so that it makes contact with a stationary contact 46. A pinion 48 also made of a suitable insulating material is mounted for rotation about an axis 50. Pinion 48 has a cavity 52 formed in it for receiving the contact end 42 as rack 40 is driven in the direction of the arrow in FIG. 2. It will be appreciated that this rack and pinion embodiment of the invention operates essentially in the same manner as that described in connection with FIG. 1. Further, it will be appreciated that this rack and pinion configuration can be configured to operate as a double-break interrupter as shown in FIG. 1 or a single interrupter as shown in FIG. 3.

Figure 3:
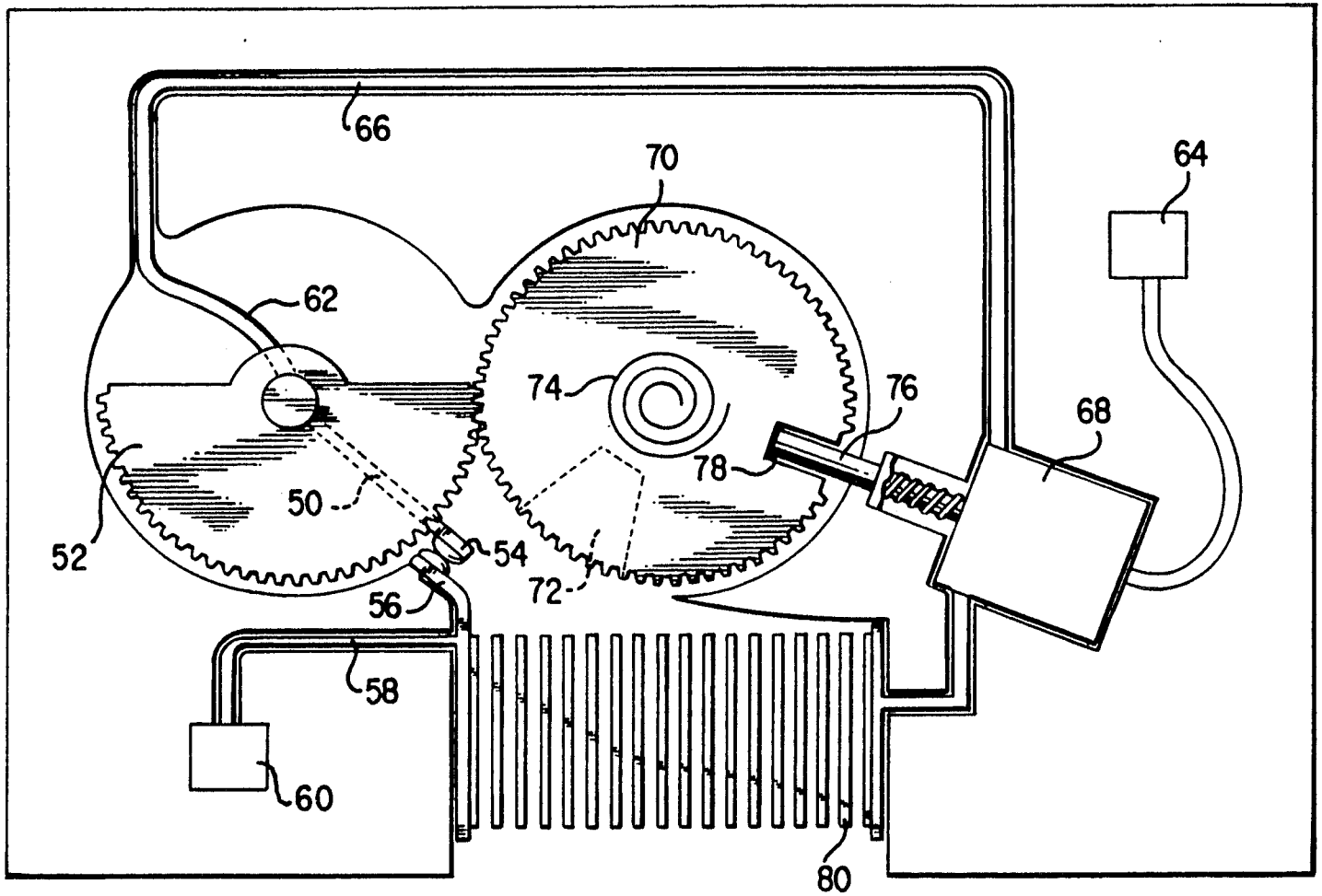
FIG. 3 is a schematic drawing of one embodiment of a single break interrupter in accordance with the teachings of the invention.

Referring now to FIG. 3, it shows one embodiment of a single-break interrupter. Here a current conducting blade 50 is embedded in an insulating gear section 52 with a contact end 54 of the blade extending from the gear section so that the end 54 is disposed to make contact with a stationary contact 56. A conductor 58 connects the stationary contact 56 to a power input terminal 60. A short length of flexible conductor 62 connects the blade 50 to a terminal 64 via solid conductor 66 and a solenoid 68. A sliding contact may be used in place of the flexible conductor 62, if desired. An insulating gear 70 has a cavity 72 formed therein to receive contact 54, and a coil spring 74 urges the gear 70 to rotate in a clockwise direction. A solenoid plunger arm 76 fits into a recess 78 in the gear 70 and latches the contacts 54 and 56 in a closed position so long as the solenoid arm is extended. A spring (not shown) maintains the arm 76 in an extended position in the absence of a current surge which generates a sufficient magnetic field to overcome the spring and withdraw the arm 76 from slot 78.

In operation, if there is current surges between terminals 60 and 64, the solenoid drives the latch 76 out of the gear recess 78 and the coil spring rotates the gear 70 in a clockwise direction, driving gear and breaking the connection between the contacts 54 and 56. When the contact 54 is completely incased in the cavity 72, a stop (not shown) prevents further rotation of the gears. In this configuration it will be appreciated that the path of least resistance for the arc is through an arc stack 80 to which the arc is thusly diverted and in which it dissipates.

Figure 4:
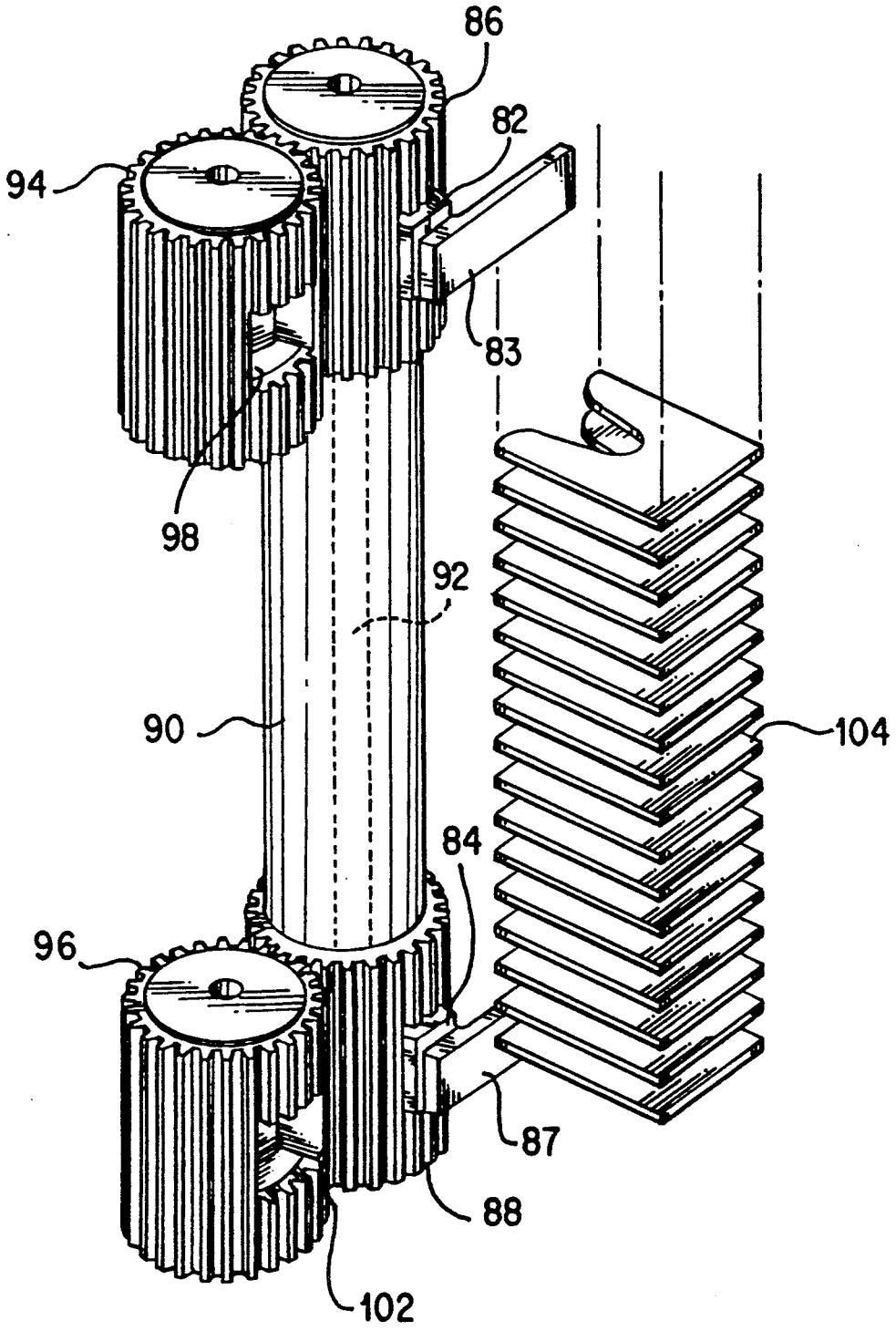
FIG. 4 is a perspective view of another embodiment of a double break embodiment of the invention.

Referring now to FIG. 4, it shows a double-break embodiment of the invention in which movable contacts 82 and 84 protrude from toothed insulating gears 86 and 88. In the position shown, the contacts 82 and 84 respectively engage fixed contacts 83 and 87. The gears are formed integrally with insulating shaft 90 in which is embedded a blade 92 which interconnects the contacts 82 and 84. Insulating pinions 94 and 96 have respective cavities 98 and 102 formed. The pinion teeth mesh with the teeth on the gears and are mounted so that as the shaft 90 rotates in a clockwise direction and contact is broken, the contacts 82 and 84 move into the cavities 98 and 102 in the pinions, thus elongating the arc path in the manner previously described so that it will divert to an arc stack 104.

Figure 5:
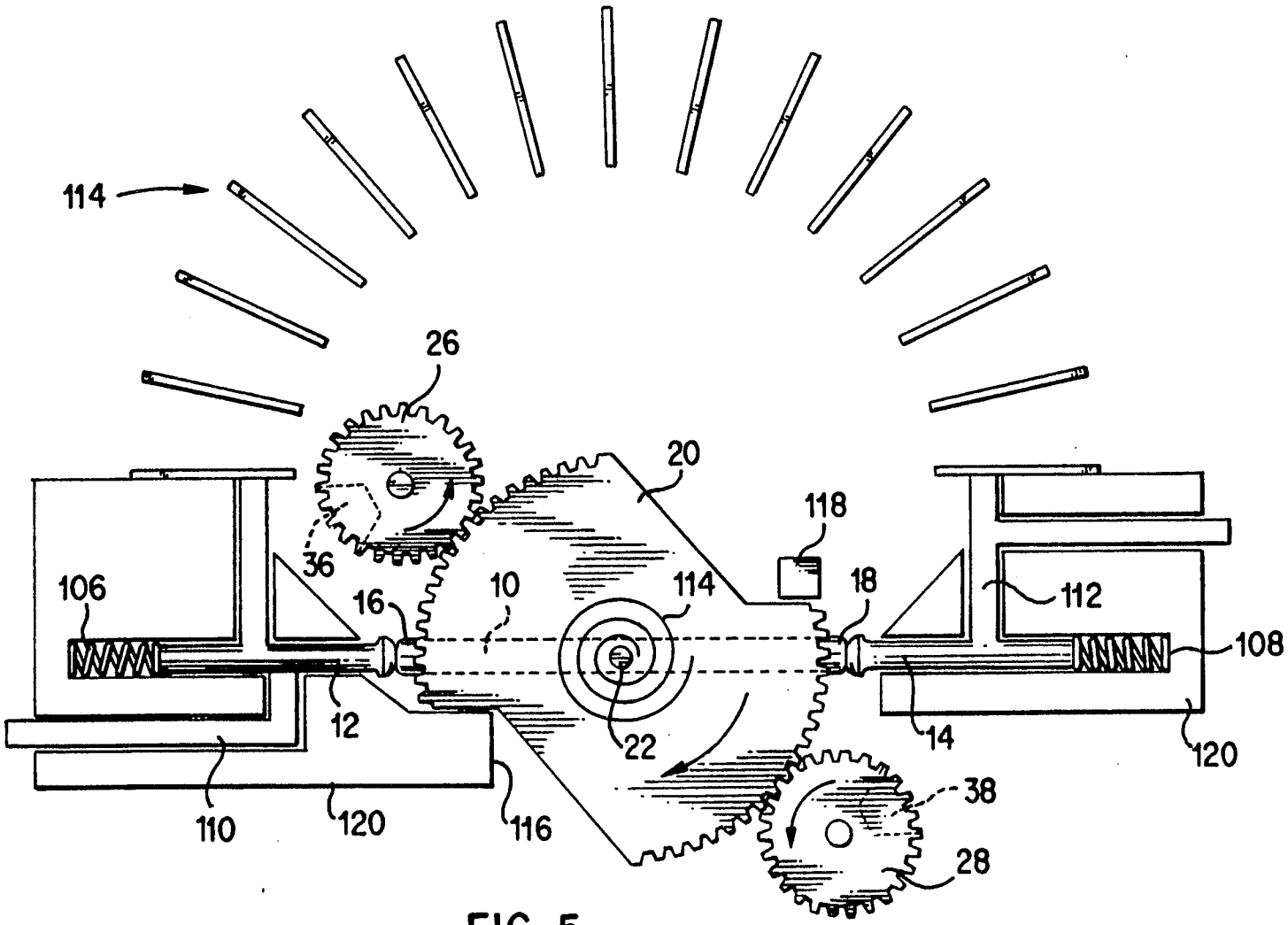
FIG. 5 is a schematic view similar to FIG. 1 of a interrupter embodying the teachings of this invention.

Referring now to FIG. 5, it shows the embodiment of the invention similar to that shown in FIG. 1 in a double-break interrupter application, and like reference numerals have been used here to designate the parts that are the same as in FIG. 1. Here the fixed contact 12 and 14 are supported in an insulated housing 120 and urged into contact with the movable contacts 22 and 24 by coil springs 106 and 108. Conductors 110 and 112 connect the fixed conductors 16 and 18 respectively to terminals outside the housing and to an arc stack 114. A coil spring 114 may be used to drive the gear 20 in a clockwise direction and stops 116 and 118 limit the motion of the gear 20 so that it stops in either its closed position, as shown, or in its open position in which the movable contact ends 16 and 18 are housed in the pinion cavities 36 and 38. The operation of this embodiment is the same as that described in connection with the previous embodiments.

While the invention has been described in terms of a single preferred embodiment, those skilled in the art will recognize that the invention can be practiced with modification within the spirit and scope of the appended claims.

Having thus described my invention, what I claim as new and desire to secure by Letters Patent is as follows:

1. A circuit interrupter comprising in combination:
a relatively fixed current conducting contact and a relatively movable current conducting contact;
a first insulating member with a set of teeth;
said relatively movable contact secured to said first insulating member;
a second insulating member with a set of teeth;
a cavity in said second member; and
means to mount said first and second insulating members so that said teeth of said first and second members mesh and so that as first member moves in a direction to separate said movable contact from said fixed contact said meshed teeth direct said movable contact into said cavity.

2. A circuit interrupter comprising in combination:
a relatively fixed current conducting contact and a relatively movable current conducting contact;
a first insulating member with a drive surface;
said relatively movable contact secured to said first insulating member;
a second insulating member with a drive surface;
a cavity in said second member; and
means to mount said first and second insulating members so that said drive surface of said first and second members engage and so that as first member moves in a direction to separate said movable contact from said fixed contact said drive surfaces direct said movable contact into said cavity.

3. A circuit interrupter comprising in combination;
a pair of relatively fixed current conducting contacts;
a first insulating member;
means mounting said first member for movement between a first and a second predetermined position;
said first insulating member having a set of teeth on a surface of said member;
a conducting blade imbedded in said first insulating member with the ends of said blade extending from said first member and forming contacts which engage said fixed contacts in said first position of said insulating member;
second and a third insulating member, each of said second and third members having a set of teeth on a surface thereof and each having a cavity formed therein;
means for mounting said second member for movement relative to said first member so that said teeth of said first member mesh with the teeth of said second member and one contact end of said blade fits in said cavity when said first member is moved to said second position;
means for mounting said third member for movement relative to said first member so that said teeth of said first member mesh with the teeth of said third member and the other contact end of said blade fits in said cavity when said first member is moved to said second position;

means for moving said first member from said first to said second positions.

4. A circuit interrupter as in claim 1, further including means for moving said first insulating member relative to said second insulating member, said moving means including means to mechanically store energy for moving said movable contact into said cavity.

5. A circuit interrupter as in claim 4, wherein said means to mechanically store energy includes a spring.

6. A circuit interrupter as in claim 2, further including means for moving said first insulating member relative to said second insulating member, said moving means including means to mechanically store energy for moving said movable contact into said cavity.

7. A circuit interrupter as in claim 6, wherein said means to mechanically store energy includes a spring.

8. A circuit interrupter as in claim 3, wherein said moving means includes means to mechanically store energy for moving said movable contacts into said cavities.

9. A circuit interrupter as in claim 8, wherein said means to mechanically store energy includes a spring.

* * * * *